US009380830B1

(12) United States Patent
Greenberg

(10) Patent No.: US 9,380,830 B1
(45) Date of Patent: Jul. 5, 2016

(54) SOLE PORTION FOR A SHOE AND PARTICULARLY HIGH HEEL SHOES

(71) Applicant: Ilene Greenberg, Boca Raton, FL (US)

(72) Inventor: Ilene Greenberg, Boca Raton, FL (US)

( * ) Notice: Subject to any disclaimer, the term of this patent is extended or adjusted under 35 U.S.C. 154(b) by 665 days.

(21) Appl. No.: 13/664,056

(22) Filed: Oct. 30, 2012

(51) Int. Cl.
*A43B 13/18* (2006.01)

(52) U.S. Cl.
CPC ..... *A43B 13/181* (2013.01); *A43B 13/182* (2013.01); *A43B 13/189* (2013.01)

(58) Field of Classification Search
CPC .... A43B 13/10; A43B 13/122; A43B 13/125; A43B 13/127; A43B 13/32; A43B 13/37; A43B 17/06; A43B 23/082; A43B 21/30
USPC ..... 36/27–28, 22 A, 38, 58, 151, 7.8, 34 R, 36/131, 8.3, 134, 73, 64–65; 74/563
See application file for complete search history.

(56) References Cited

U.S. PATENT DOCUMENTS 1,380,879 A * 6/1921 Young ..... A43B 17/06 36/28
4,457,084 A * 7/1984 Horibata et al. ..... 36/7.8
5,459,946 A * 10/1995 Rayow ..... 36/8.3
5,502,901 A * 4/1996 Brown ..... A43B 1/0018 36/27
5,566,478 A * 10/1996 Forrester ..... 36/134
5,671,552 A * 9/1997 Pettibone et al. ..... 36/27
5,832,629 A * 11/1998 Wen ..... A43B 21/30 36/27
7,526,880 B2 * 5/2009 Polcek ..... 36/44
2004/0154191 A1 * 8/2004 Park ..... 36/28
2009/0094856 A1 * 4/2009 Guerra ..... 36/29
2009/0145003 A1 * 6/2009 Kim ..... 36/44

* cited by examiner

*Primary Examiner* — Robert J Hicks
*Assistant Examiner* — Timothy K Trieu
(74) *Attorney, Agent, or Firm* — The Concept Law Group, P.A.; Scott D. Smiley; Erin A. Martin

(57) ABSTRACT

An improved sole for a high heel shoe comprising a bottom member, support member and top member. The top member can be provided with an upper cavity for the receipt of a gel or other cushioning member. The support member extends downward from the top member and provides the downwardly extending female receiving ports for fasteners used to secure the bottom member to the support member. A plurality of springs are positioned within an internal chamber created by the attachment of the bottom member to the support member. A slip resistance sole can be provided on the bottom surface of the bottom member. A shoe upper and gel cover are secured to the top member. The cushioning gel and the springs provide additional comfort to the wearer when walking or standing in the shoe. A soft padding material can be secured to the inner surface of the shoe upper.

15 Claims, 5 Drawing Sheets

SOLE PORTION FOR A SHOE AND PARTICULARLY HIGH HEEL SHOES

FIELD OF THE INVENTION

The present invention relates generally to the construction of shoes, such as high heel shoes, and particularly to an improved sole portion of the shoe for increased comfort for the wearer.

BACKGROUND OF THE INVENTION

Wearing high heel shoes for extended periods of time is known to be uncomfortable for the wearer. Despite being uncomfortable, women continue to wear high-heel shoes for various occasions and fashion reasons. The present invention is directed to overcoming or reducing some of the unpleasantness currently experienced by women when wearing high heel shoes.

SUMMARY OF THE INVENTION

The present invention generally provides for an improved sole portion for a shoe, such as, but not limited to, a high heel shoe. The improved sole portion of the present invention provides for a multi-component sole portion, preferably comprising a bottom member, support member and top member. The top member can be provided with an upper cavity for the receipt of a gel or other cushioning member. The support member extends downward from the top member and provides the downwardly extending female receiving ports for attachment fasteners used to secure the bottom member to the top member/support member. The support member can be a separate component from top member or they can be molded or monolithically formed as a one-piece member.

As mentioned above, the bottom member can be secured to the top member/support member through one or more, and preferably, a plurality of fasteners. In a preferred, but non-limiting embodiment, the fasteners can be screws. The bottom member can be provided with passageways for inserting the fasteners upward through the lower portion of the bottom member for a preferred threaded engagement (i.e., where screws are chosen for the fastener) with corresponding female receiving ports extending down from the support member. Internal ledges defined by differing diameter portions of the bottom member passageways, act as stop members, with respect to the heads of the fasteners, such that the fasteners cannot be inserted all the way through bottom member, which would prevent the bottom member from being secured to the top member/support member.

One or more, and preferably, a plurality of springs are positioned within an internal chamber created by the attachment of the bottom member to the top member/support member. The springs can be maintained in position by one or more of the following configurations: (1) Top and bottom protrusions can be provided in support member and bottom member, respectively, which are inserted at the respective ends of each spring. In this embodiment, the ends of the springs abut or can come in contact with the inner surfaces of the support member and the bottom member; (2) the receiving ports and the passageway ports of the top member and the bottom member, respectively, can also serve as protrusions which are inserted within respective ends of each spring. Similarly, in this embodiment, the ends of the springs abut or can come in contact with the inner surfaces of the support member and the bottom member; and (3) the receiving ports do not get inserted within the spring ends, but rather the spring ends abut or come into contact with the outer end of the receiving ports, and the passageway ports and the attachment fasteners, in addition to securing the bottom member to the top member/support member, also serve to maintain the springs in the proper position, as the springs are disposed around the attached fasteners.

A slip resistant sole can be provided on the bottom surface of the bottom member which provides for improved shoe gripping with the surface. In one non-limiting embodiment, the slip resistance sole can be a rubber sole, though other materials can be used and are considered within the scope of the invention. The shoe upper can be secured to the top member and gel cover can also be secured to the top member so that the wearer's foot does not directly come into contact with the cushioning gel.

In one embodiment, a perimeter groove is defined by the attachment of the bottom member to the top member/support member. As the groove can also provide access to internal chamber where the springs are disposed, a rubber gasket or seal can be disposed in the groove in order to prevent or at least reduce the amount of dirt and/or liquid that enters into the internal chamber.

The cushioning gel and springs provide additional comfort to the wearer when walking or standing in the shoe, as compared to a conventional high heel shoe. Padding, such as, but not limited to, a soft material, can be secured to the inner surface of the shoe upper to provide additional padding and comfort for the wearer. In one embodiment, a neoprene material can be used for the padding, such as, but not limited to neoprene offered under the trademark NEOLONE®. However, the padding material is not considered limited to neoprene or NEOLONE® material and any appropriate material with the same or similar desired properties can be used for the padding and all are considered within the scope of the invention.

DETAILED DESCRIPTION OF THE DRAWINGS

Figure 1:
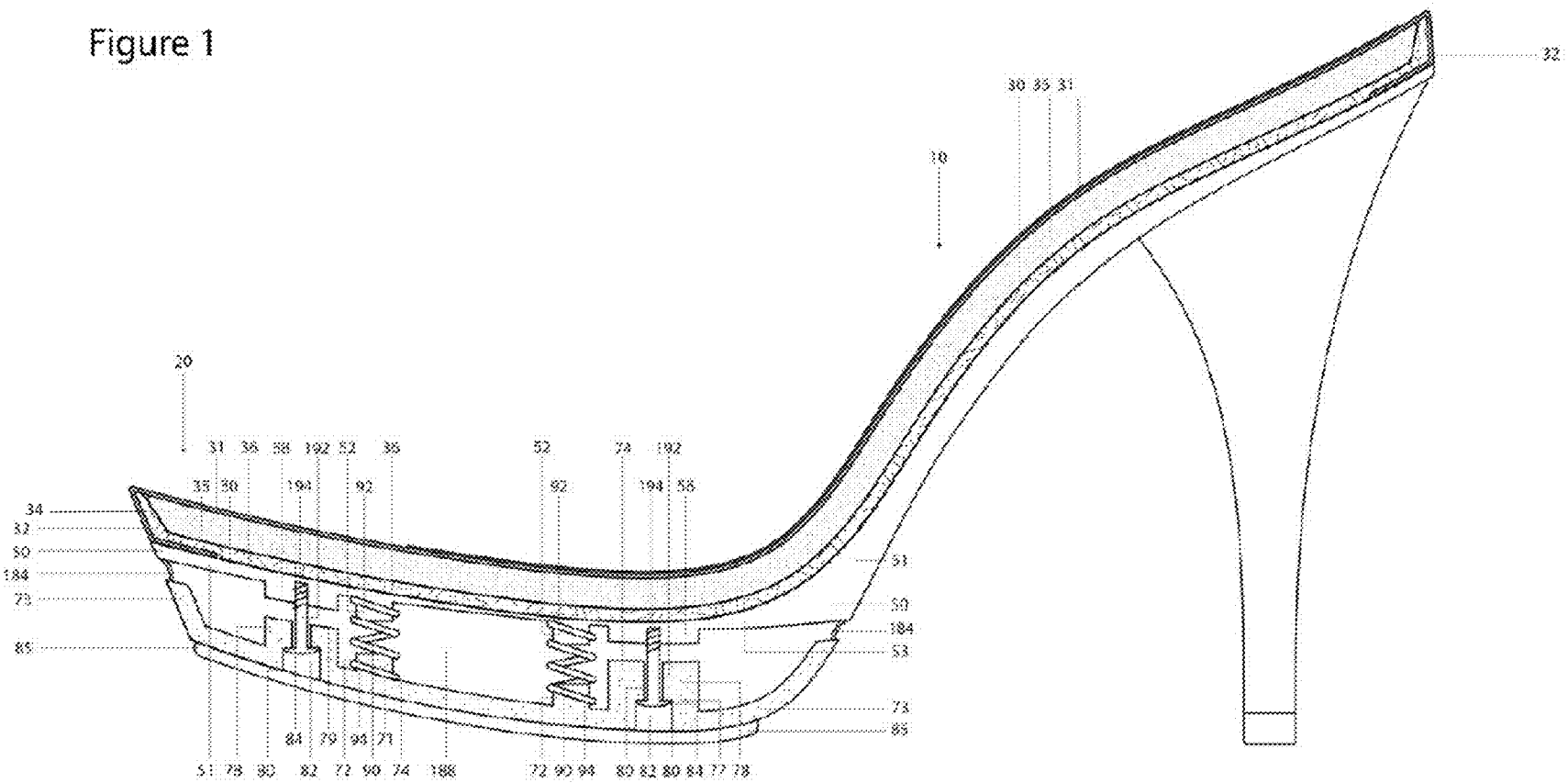
FIG. 1 is a side sectional view of a high heel shoe showing an improved sole portion of the shoe in accordance with the present invention.

As seen in the drawings, the present invention provides for an improved sole portion for a high-heel shoe 10. The improved sole portion will be generally designated as sole portion 20. In the preferred embodiment, the sole portion 20 can be constructed from multiple parts, including, but not limited to, a top member 30, a support member 50 disposed underneath the top member 30, a bottom member 70, and one or more springs 90 disposed between the bottom member 70 and the support member 50. A bottom gripping surface 85 can be disposed on a bottom surface 113 of the bottom member 70.

The top member 30 can be provided with a sidewall 32 which defines a central area or cavity 34 which serves as a housing or enclosure for holding a comfort or cushion gel 35 that is poured, placed or otherwise disposed within the cavity 34. In lieu of a gel, another cushioning member can be disposed within cavity 34 and is also considered within the scope of the invention. A perimeter of a front portion of a bottom surface 36 of the top member 30 can serve as a securement point for attaching a shoe upper 130. The shoe upper 130 can be attached to bottom surface 36 by any conventional means, such as, but not limited to, adhesives, tapes, staples, glues, welding, etc. The shoe upper 130 can be constructed from leather or any other known shoe upper material and all are considered within the scope of the invention. A cover 37, preferably constructed from leather, though such is not considered limiting, can also be provided for cushion gel 35 or any other cushioning material that is disposed within the cavity 34. Where the cover 37 is provided, it can be secured to the bottom surface 36 by any of the above mentioned conventional means, and is positioned such that the attachment is between the bottom surface 36 and the shoe upper 130.

A thin piece of padding 38 can be secured to an inner surface of the shoe upper 130 by any known conventional means. The padding 38 comes into direct contact with the wearer's foot, when the shoe 10 is properly worn by the wearer. The padding 38 provides additional comfort to the wearer, and prevents direct contact and rubbing with the shoe upper 130 which could cause irritation, blisters, etc. In one non-limiting embodiment, the padding 38 can be constructed from a neoprene material, such as the firm neoprene offer under the trademark NEOLONE®. However, other soft materials which provide the same or similar desired properties can also be used and are considered within the scope of the invention.

Figure 4:
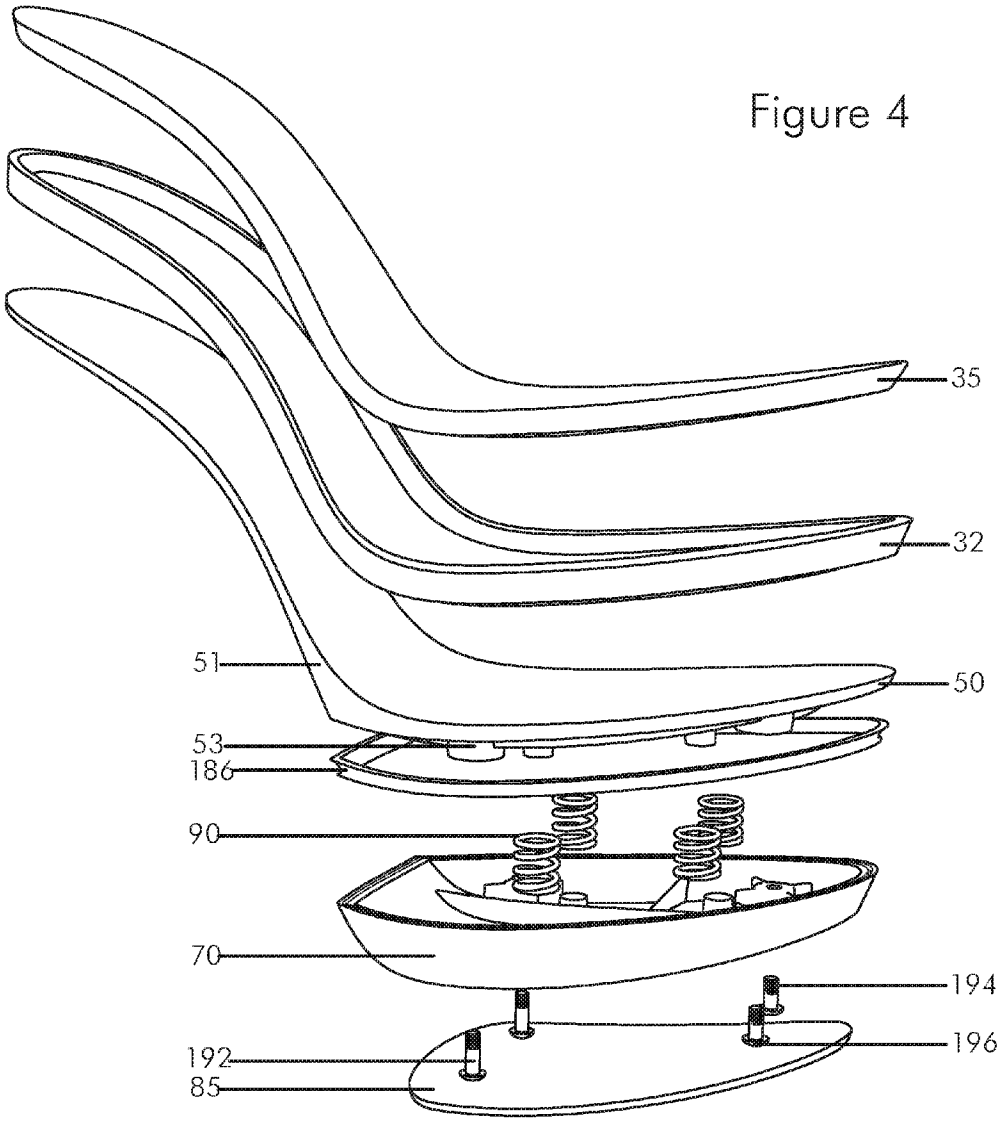
FIG. 4 is an exploded view of at least some of the preferred components that comprise the improved sole portion of the shoe in accordance with the present invention.
Figure 5:
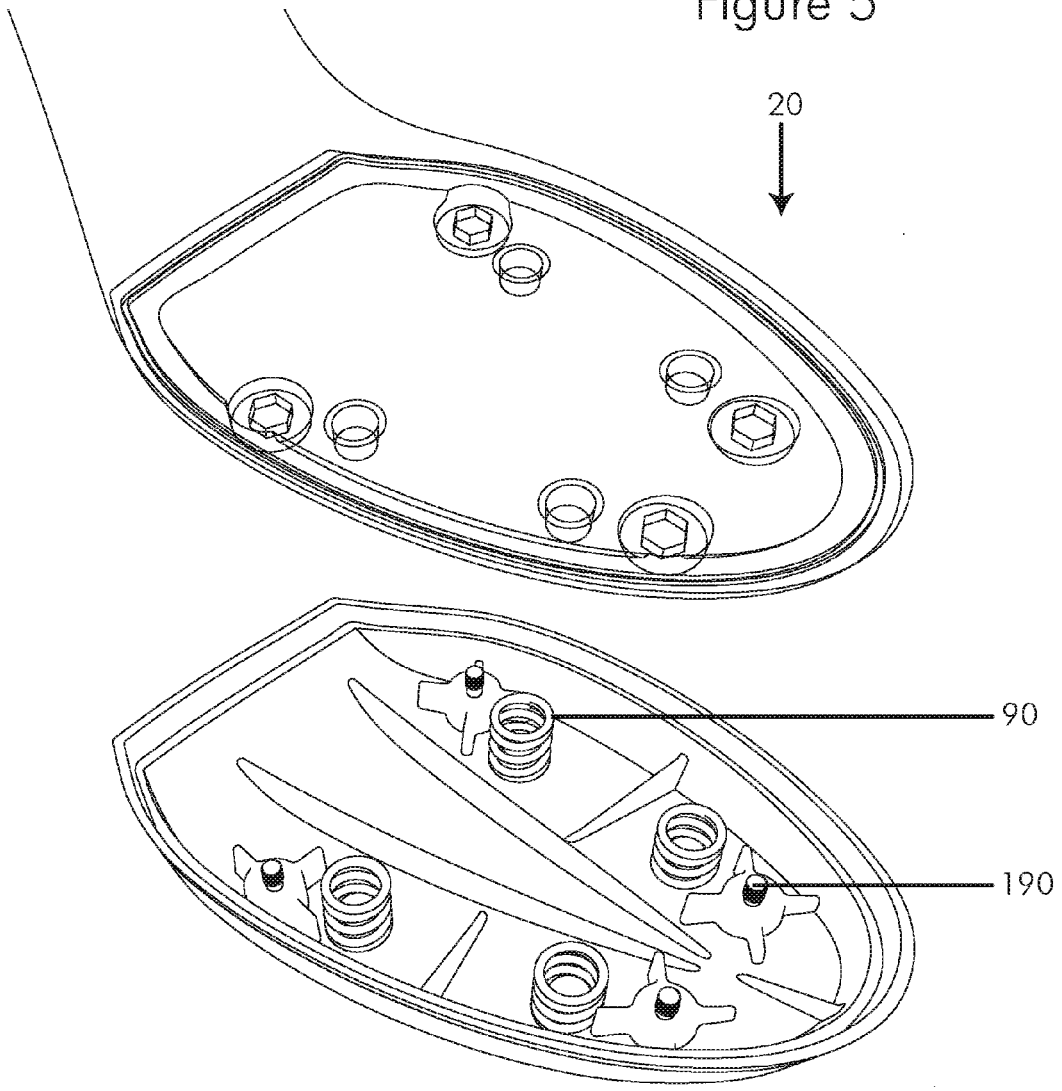
FIG. 5 is an exploded view of a portion of the improved sole portion showing the a plurality of springs positioned adjacent a plurality of fasteners.
Figure 6:
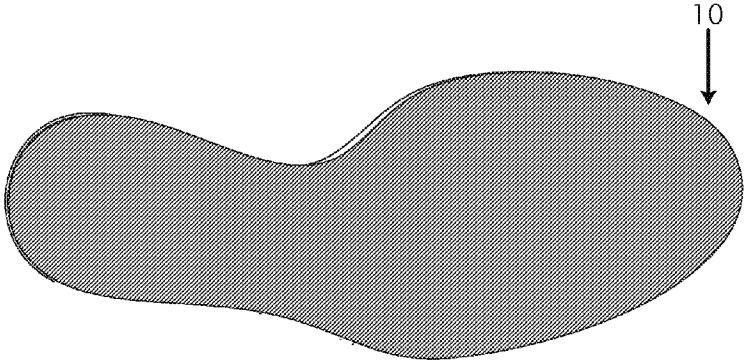
FIG. 6 is a top plan view of the shoe showing the high heel shoe assembled in accordance with the present invention.
Figure 7:
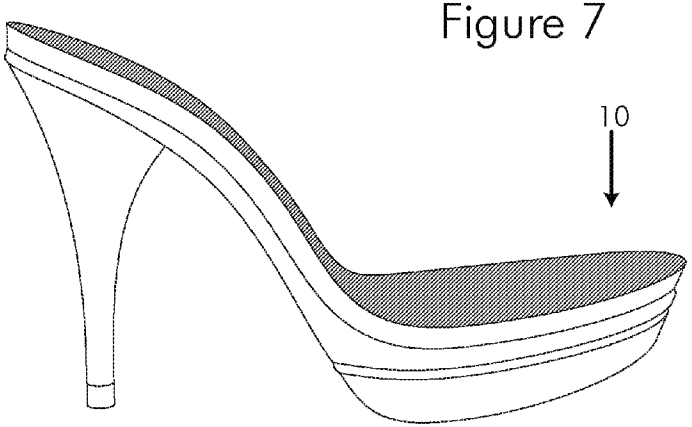
FIG. 7 is a side view of the shoe showing the shoe in an assembled configuration in accordance with the present invention.
Figure 8:
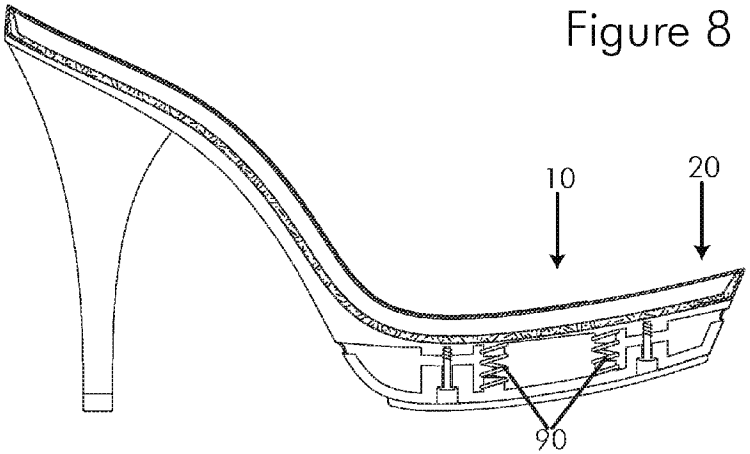
FIG. 8 is a front view of the shoe showing the shoe in an assembled configuration in accordance with the present invention.
Figure 9:
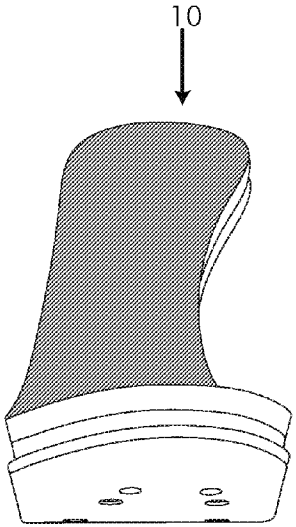
FIG. 9 is a cross-sectional side view of the shoe showing the plurality of springs and the plurality of fasteners of FIG. 5.

The support member 50 can be secured to the bottom surface 36 preferably in a central area of the bottom surface 36, such that when the support member 50 is secured to the top member 30 the perimeter securement area of the bottom surface 36, where the shoe upper 130 and the cushioning cover 37 are secured, is easily seen and defined. The support member 50 can be constructed from molded plastic, though such is not considered limiting generally. The support member 50 can comprise a shoe length portion 51 and a downward portion 53 (containing the protrusions and ports described in detail below) which can be two pieces secured together (See FIG. 4) or monolithically formed as one piece (See FIG. 1). The support member 50 helps to provide support for the wearer's foot and helps to maintain the plurality of springs 90 in place, which will be discussed in more detail below. The support member 50 may also serve as securement points for the attachments fasteners 190, which will also be described in more detail below, for securing the bottom member 70.

As best seen in FIG. 1, when the support member 50 is secured to the bottom surface 36, one or more top stubs or protrusions 52 depend downward, with each protrusion 52 serving as a top positioning member for a top or first end 92 of an associated spring 90. Preferably, the outer diameter of the protrusion 52 is at least slightly smaller than the inner diameter at the end 92 of the associated spring 90, such that the protrusion 52 becomes inserted within the associated spring 90 at the end 92, when the sole portion 12 of the shoe 10 is properly assembled. The one or more springs 90 provide resistance and help to separate the top member 30 and the support member 50 from the bottom member 70, as well as cushioning the impact from walking in the shoes 10 by the wearer. After the wearer steps down, the one or more springs 90 will provide a little lift off to help propel the wearer forward, while wearer's step is cushioned from the cushioning gel contained within the cavity 34.

Preferably, the number of springs 90 corresponds to the number of protrusions 52. However, it is also within the scope of the invention, that front portion 12 can be assembled with less springs, than protrusions, which allows differing amounts of "spring" effect for the shoes, depending on the number of springs and/or their locations provided, prior to final assembly. Thus, where special orders are available, the user can customize the amount of "spring" effect for their shoe, prior to the shoes final assembly.

Also depending downward from the bottom surface 36 as part of the support member 50, are one or more female receiving ports 58, preferably having internal threads 60, for receiving an associated retaining fastener 190, for retaining the bottom member 70 to the support member 50. Preferably, the number of receiving ports 58 corresponds to the number of retaining fasteners 190, though such is not considered limiting. In one non-limiting embodiment, the fasteners can be screws having screw heads though such is not considered limiting and other types of fasteners of varying types of material can be used as the fastener and are all considered within the scope of the invention.

Figure 3:
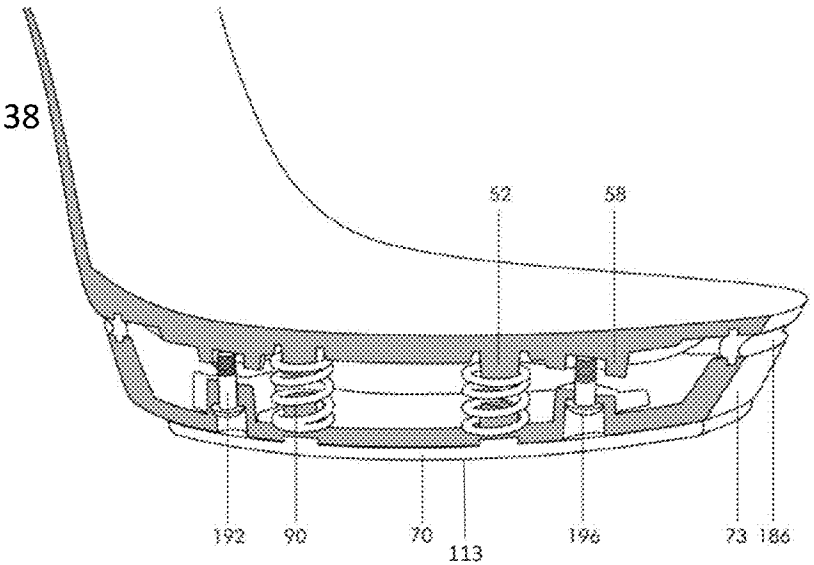
FIG. 3 is a front partial perspective view of an alternative improved sole portion.
Figure 2:
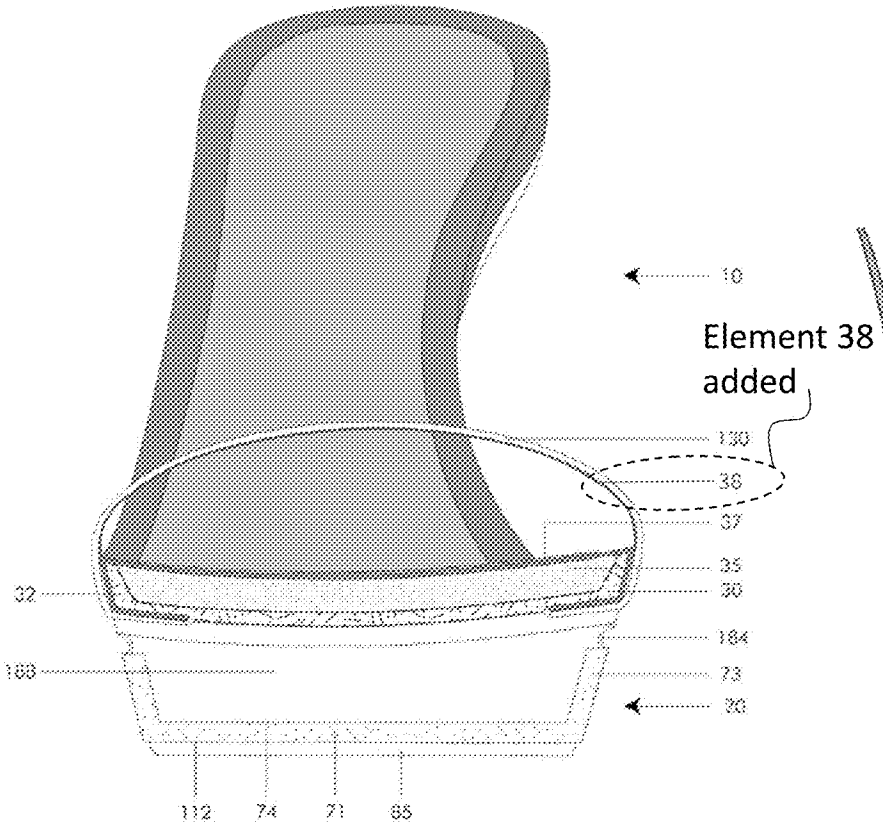
FIG. 2 is a front sectional view of the improved sole portion of FIG. 1.

Additionally, by making the outer diameter of the receiving ports 58, and the outer diameter of the ports 78 of the bottom member 70, smaller than the inner diameter of the spring 90, it is also within the scope of the invention, that each pair of ports 58/78, can also serve as the spring positioning protrusions (top and bottom), in addition to serving as the fastener attachment points. Such configuration eliminates or complements the top protrusions 52 of the support member 50 which are disposed a distance 54 from one or more bottom protrusions 72 of the bottom member 70. As shown in FIG. 1, it is also within the scope of the present invention for the ports 58/78 to be disposed a distance 55 from each other. The distance 55 is depicted as being smaller than the distance 54. As seen in FIG. 3, as a further alternative embodiment, the spring 90 can also be constructed such that its inner diameter is not larger than the ports 58/78 and, thus, the ports 58/78 do not enter within the ends of spring 90. Instead, each spring 90 can abut the outer surfaces of its associated ports 58/78 to be retained in position by the associated fastener 190 which is passed through the spring 90 when the fastener 190 is secured to the top receiving port 58.

The bottom member 70, in conjunction with the top member 30 and the support member 50, houses one or more springs 90, and also provides passageways for permitting one or more fasteners 190 to be inserted upward for connecting to the ports 58 on the support member 50. Preferably, the fasteners 190 are not directly fixed or secured to the bottom member 70, but rather are secured at receiving ports 58. The bottom member 70 includes a bottom portion 71 and a sidewall 73. The bottom member 70 can be constructed from molded plastic, though such is not considered limiting. Extending upward from an inner surface 74 of the bottom portion 71 can be one or more bottom stubs or protrusions 72. The bottom protrusions 72 function similar to the top protrusions 52 but are secured to the opposite second or bottom end 94 of an associated spring 90. Also similar to the protrusion 52, preferably, the outer diameter of the bottom protrusion 72 can be at least slightly smaller than the inner diameter at the end 94 of the associated spring 90, such that the protrusion 72 becomes inserted within the associated spring 90 at the end 94, when the sole portion 12 of the shoe 10 is properly assembled. Preferably, the number of springs 90 provided corresponds to the number of protrusions 72. However, as mentioned above, it is also within the scope of the invention, that front portion 12 can be assembled with less springs, than protrusions 72.

Also depending upward from the inner surface 74 of the bottom portion 71 are one or more attachment screw positioning ports 78. Each port 78 can preferably consist of a two-part passageway 77 having a first end 79 and a second end 80. The passageway 77 can include a first portion 80 which begins at first end and terminates-into a second portion 82 prior to reaching the second end 80. The diameter of the first portion 80 is preferably smaller than the diameter of the second portion 82 which defines a ledge 84 where the first portion 80 and the second portion 82 meet and are in communication with each other. When a screw is used as the retaining fastener 190, it can consist of a post portion 192, preferably having threads 194, and a screw head 196. The outer diameter of the post portion 192 can be smaller than the inner diameter of both the first portion 80 and the second portion 82 of the passageway 77. Such configuration allows an attachment end 198 of the post portion 192 to be inserted through both portions of the passageway 77 for receipt by an associated receiving port 58 of the support member 50 when securing the bottom member 70 to the support member 50. Preferably, the threads 194 of the post portion 192 mate with the internal threaded portion 60 (where screws are chosen for the fastener 190) of the receiving port 58 to maintain the secure attachment of the bottom member 70 to support member 50.

The diameter of the screw head 196 can be smaller than the diameter of the second portion 82 but larger than the diameter of the first portion 80. Thus, the screw head 196 does not fit within the portion of passageway 77 defined by first portion 80, which causes ledge 84 to act as a stop member when inserting the fastener 190 into the passageway 77. Said another way, the fastener 190 can only be inserted within the passageway 77 to the point where the screw head 196 contacts the ledge 84), thus, preventing the fastener 190 from being inserted all the way through the passageway 77. Preferably, each port 78 is associated with a port 58 of the support member 50 and a specific fastener 190.

The securement of the bottom member 70 to the support member 50 can define a groove or opening 184. A sealing member, such as, but not limited to, a gasket 186 can be disposed within the groove 184. Preferably, the gasket 186 can be constructed from a rubber material, though such is not considered limiting, and provides flexibility which will help to reduce or prevent dirt and liquids from entering within the internal chamber 188 defined by the support member 50 and the bottom member 70 where the springs 90 are housed.

The top member 30, with the support member 50, can be considered the upper sole portion and the bottom member 70 can be considered the bottom sole portion. The top member 30, the support member 50 and/or the bottom member 70 can be constructed from durable, rigid or hard material, such as, but not limited to polyurethane, ABS, plastic, etc.

A gripping member can be adhered or otherwise secured to an outer surface 112 of the bottom portion 71, and in a preferred embodiment, can be a slip resistance sole. In one non-limiting embodiment the slip resistance sole can be a rubber sole 85, though such is not considered limiting and other materials can be used and are all considered within the scope of the invention. The rubber sole 85 can be provided for improved grip of the ground surface and comfort when the wearer is walking in the shoe 10. The rubber sole 85 also helps to prevent wear and tear on the bottom member 70, since it acts as a barrier and prevents the bottom member 70 from directly contacting the ground when the wearer of the shoe 10 is walking or standing. The rubber sole 85 also covers the openings/passageway 77 and the screws 190, and thus helps to prevent dirt and liquids from inside the internal chamber 188 through one or more passageways 77. The rubber sole 85 can also to provide slip resistance for the shoe 10.

Though the improved sole portion for a shoe described above, is preferably used with high heel shoes, such is not considered limiting, and it is also within the scope of the invention to incorporate the improved front portion into non-heeled or lower heeled shoes, sneakers, sandals, etc. Where a non-healed or lower heeled shoe is provided the shape of the top member 30 and the portion 51 of the support member 50 will be preferably less vertical and more horizontal (throughout its entire length) for lower heeled shoes, and possibly virtually horizontal (throughout its entire length) for non-heeled shoes.

It is also within the scope of the invention to have the features of the top member 30 and the support member 50 as a one piece member. In such embodiment, the gel cavity will be located at the top of the one piece member and the one piece member will have its protrusions and/or receiving ports depending downward from its lower surface.

All locations, sizes, shapes, proportions, measurements, amounts, angles, component locations, part locations, fasteners, configurations, weights, dimensions, values, percentages, materials and/or orientations discussed above or shown in the drawings are merely by way of example and are not considered limiting and other locations, sizes, shapes, proportions, measurements, amounts, angles, component locations, part locations, fasteners, configurations, weights, dimensions, values, percentages, materials and/or orientations can be chosen and used and all are considered within the scope of the invention.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A sole for a shoe, comprising:

an upper member shaped to receive a user's foot;

a bottom member secured to said upper member and defining an internal chamber therebetween;

at least one downwardly extending protrusion extending in a downward direction away from the upper member and toward the bottom member;

at least one upwardly extending protrusion extending in an upward direction away from the bottom member and toward the upper member and disposed a first distance from the at least one downwardly extending protrusion;

at least one spring disposed within said internal chamber and spanning between said at least one downwardly extending protrusion and said at least one upwardly extending protrusion;

at least one downwardly extending receiving port extending in a downward direction away from the upper member and toward the bottom member;

at least one upwardly extending receiving port extending in an upward direction away from the bottom member and toward the upper member and disposed a second distance from the at least one downwardly extending receiving port, the second distance smaller than the first distance; and a non-compressible retaining fastener disposed between the at least one downwardly extending receiving port and the at least one upwardly extending receiving port and securing said bottom member to said upper member.

2. The shoe sole of claim 1, wherein:

the sole is coupled to a high heel shoe.

3. The shoe sole of claim 1, further comprising:

an upper cavity defined by the upper member, the upper cavity including a cushioning member disposed within the upper cavity.

4. The shoe sole of claim 3, further comprising:

a cover member disposed over said cushioning member and secured to said upper member.

5. The shoe sole of claim 1, further comprising:

a shoe upper secured to at least a portion of said upper member.

6. The shoe sole of claim 5, further comprising:

a padding material secured to an inner surface of said shoe upper.

7. The shoe sole of claim 6, wherein:

said padding material is constructed from a cushion material.

8. The shoe sole of claim 1, further comprising:

a gripping member secured to an outer surface of said bottom member.

9. The shoe sole of claim 1, wherein:

said retaining fastener is secured to said at least one downwardly extending receiving port through a threaded relationship.

10. The shoe sole of claim 1, further comprising:

a slip resistance member secured to an outer surface of said bottom member below the retaining fastener.

11. The shoe sole of claim 1, further comprising:

a perimeter groove defined by the securement of said bottom member to said upper member; and a sealing member disposed within said perimeter groove.

12. The shoe sole of claim 11, wherein:

said sealing member is a perimeter gasket.

13. A sole for a high heel shoe, comprising:

a top member defining a cavity spanning at least a portion of a length of the top member; a cushion material disposed within said cavity;

a support member secured to said top member, said support member having a plurality of downwardly extending protrusions;

a bottom member secured to said support member to define an internal chamber therebetween, said bottom member having a plurality of upwardly extending protrusions disposed a first distance from the plurality of downwardly extending protrusions;

a plurality of springs disposed within said internal chamber, each of said springs including a first end contacting at least one of the plurality of upwardly extending protrusions and a second end contacting an inner surface of said support member at least one of the plurality of downwardly extending protrusions; at least one downwardly extending receiving port extending in a downward direction away from the support member and toward the bottom member;

at least one upwardly extending receiving port extending in an upward direction away from the bottom member and toward the support member and disposed a second distance from the at least one downwardly extending receiving port, the second distance being smaller than the first distance; and at least one non-compressible retaining fastener disposed between the at least one downwardly extending receiving port and the at least one upwardly extending receiving port within said internal chamber and securing said bottom member to said support member.

14. The sole for a high heel shoe of claim 13, further comprising:

a shoe upper secured to at least a portion of a bottom perimeter surface of said top member;

a cover member disposed over said cushion material and secured to at least a portion of said bottom perimeter surface of said top member; and a slip resistance member secured to an outer surface of said bottom member.

15. The sole for a high heel shoe of claim 14, further comprising:

a padding secured to an inner surface of said shoe upper.

* * * * *